US006910326B2

(12) United States Patent
Stephan et al.

(10) Patent No.: US 6,910,326 B2
(45) Date of Patent: Jun. 28, 2005

(54) CLEANING DEVICE FOR THE CLEANING OF A SPIN ROTOR AND SCRAPER ELEMENT

(75) Inventors: Adalbert Stephan, Beilngries/Paulushofen (DE); Ralf Limmer, Bettbrunn (DE); Gerd Stahlecker, Eislingen/Fils (DE)

(73) Assignee: Rieter Ingolstadt Spinnereimaschinenenbau AG, Ingolstadt (DE)

( * ) Notice: Subject to any disclaimer, the term of this patent is extended or adjusted under 35 U.S.C. 154(b) by 137 days.

(21) Appl. No.: 10/386,124

(22) Filed: Mar. 11, 2003

(65) Prior Publication Data

US 2004/0079068 A1 Apr. 29, 2004

(30) Foreign Application Priority Data

Mar. 13, 2002 (DE) ..... 102 12 351
Jul. 12, 2002 (DE) ..... 102 31 484

(51) Int. Cl.[7] ..... D01H 4/24
(52) U.S. Cl. ..... 57/302
(58) Field of Search ..... 57/301, 302, 304; 15/93.1, 104.09, 104.095, 104.096, 104.13, 104.15, 104.16, 256.5

(56) References Cited

U.S. PATENT DOCUMENTS 3,524,312 A * 8/1970 Landwehrkamp et al. .... 57/302
3,662,532 A 5/1972 Stahlecker
3,848,289 A * 11/1974 Bachmann ..... 15/246.5
3,869,851 A * 3/1975 Muller ..... 57/302
4,058,963 A 11/1977 Stahlecker
4,125,991 A * 11/1978 Stahlecker ..... 57/302
4,135,354 A * 1/1979 Stahlecker ..... 57/302
4,339,914 A 7/1982 Pfeifer
4,480,433 A 11/1984 Ryer, II
4,542,620 A * 9/1985 Kase et al. ..... 57/302
4,548,030 A * 10/1985 Lauschke et al. ..... 57/302
4,897,993 A 2/1990 Raasch et al.
5,083,421 A 1/1992 Raasch et al.
5,245,818 A * 9/1993 Scheufeld et al. ..... 57/304
5,335,388 A * 8/1994 Salecker ..... 15/104.12
6,516,600 B2 * 2/2003 Paweletz ..... 57/302
2002/0073685 A1 6/2002 Paweletz
2003/0177750 A1 9/2003 Limmer

FOREIGN PATENT DOCUMENTS

DE 2618094 11/1977
DE 2629161 A1 1/1978
DE 10057230 A1 5/2002
JP 03014635 A * 1/1991 ..... D01H/4/24

OTHER PUBLICATIONS

German Search Report, Jul. 12, 2002.
EPO Search Report, Feb. 4, 2004.

* cited by examiner

*Primary Examiner*—John J. Calvert
*Assistant Examiner*—Shaun R. Hurley
(74) *Attorney, Agent, or Firm*—Dority & Manning, P.A.

(57) ABSTRACT

The invention concerns a cleaning apparatus for the cleaning of a spin rotor of a spinning station leaning head which can be insertably presented to the spin rotor and on which cleaning head are placed at least two scraper elements. In accord with the invention, the at least two scraper elements are pneumatically extendable, wherein the position of the two scraper elements are so secured on the outer circumference of the cleaning head, that the sum of the contact forces which are exerted from the scraper element in the radial direction onto the rotor is zero, or practically zero.

33 Claims, 4 Drawing Sheets

D
11
2
7'
4
5
13
7
3
14
B
C
II
15'
E
A
15
12
16'
16
9
8'
6
1
8
3'
17
10

7'
7
3
A
8'
15
8'
8
8
14
7
7'

A-A

A-A

B-B

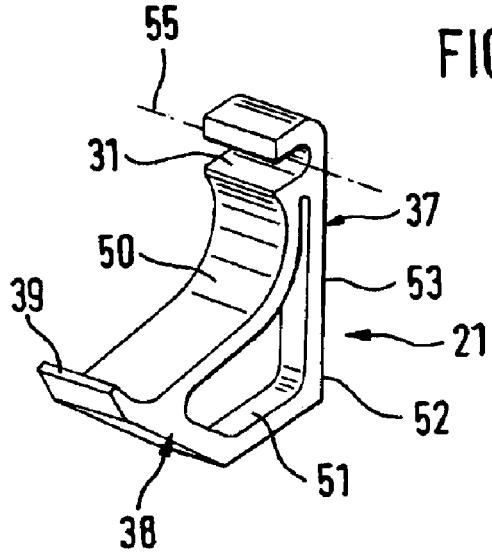
FIG.5
FIG.6
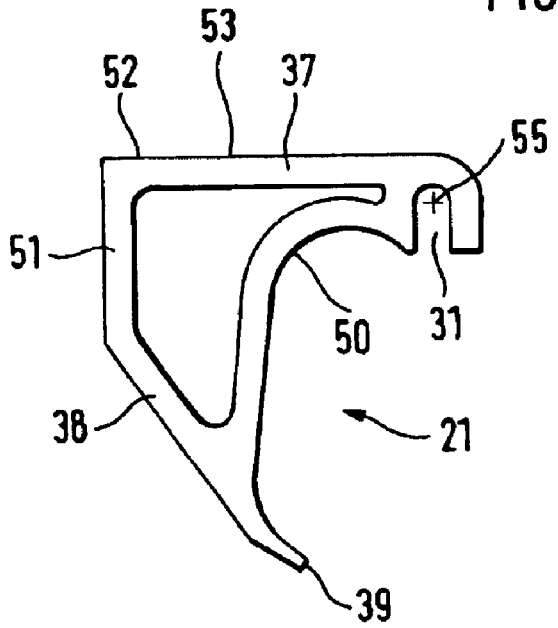

CLEANING DEVICE FOR THE CLEANING OF A SPIN ROTOR AND SCRAPER ELEMENT

BACKGROUND OF THE INVENTION

The invention concerns a cleaning apparatus for the cleaning of a spin rotor in a rotor spinning machine, with a cleaning head which can be insertably presented to a spin rotor on which at least two scraper elements are placed and the invention also concerns a scraper element corresponding thereto.

U.S. Pat. No. 4,339,914 discloses a cleaning apparatus which is mounted on a service cart which is capable of movement, whereby the apparatus can be presented to a spin rotor for the cleaning of the same. On the cleaning head of the cleaning apparatus, a scraper is placed, which, by means of a pneumatic cylinder can cleaningly enter into the rotor groove of the spin rotor. For the cleaning of the rotor groove, the spin rotor is caused to rotate. In order to achieve a sufficient cleaning effect, the scraper must be subjected to pressure to achieve a correspondingly sufficient force of cleaning contact. On this account, the spin rotor receives an asymmetric loading, which especially contributes to a tilting of the rotor in its bearing, and because of the necessity of rotating the rotor, a one-sided, atypical operational loading of the spin rotor results. As rotor bearing technology advances, and with the development of aero and magnetic bearings, the bearings have become more sensitive in regard to such nontypical loadings.

The DE 26 29 161 shows various embodiments of cleaning apparatuses, these being equipped with different accoutrements including scrapers, brushes and compressed air nozzles. In one embodiment, two oppositely situated scraper elements can penetrate into the rotor groove. In this arrangement, the scraper elements are fastened on one end on leaf springs, while the other end thereof is affixed to a pivoting axle. In order to insert the cleaning head, the leaf springs are pretensioned in the direction of the pivot axle, so that the scrapers can penetrate through an opening in the rotor bowl. After the penetration, the axle is rotated. By centrifugal force, the scrapers withdraw from the leaf springs until the scrapers enter the rotor groove. Because of the spring loading, the contacting force of the scrapers is essentially determined by the centrifugal force. Due to the resilient support, the scraper elements can begin to oscillate inside the rotor groove, so that the cleaning effectiveness cannot be uniform. The adjustment of the contacting force by means of changing the centrifugal force is limited in its possibilities and hence a secure application of the cleaning elements in the rotor groove cannot be assured.

OBJECTS AND SUMMARY OF THE INVENTION

It is, therefore, a principal purpose of the invention to provide a cleaning apparatus for the cleaning of a spin rotor, wherein the cleaning head is constructed in a very compact manner, and wherein a sufficient contacting force of at least one scraper element within the rotor groove is assured. Further, it is within this purpose, that during the cleaning of the spin rotor the least possible force is to be exercised against the rotor bearing. A primary objective of a scraper element corresponding to the invention is to properly direct the application of force for the cleaning of the rotor. Additional objects and advantages of the invention will be set forth in part in the following description, or may be obvious from the description, or may be learned through practice of the invention.

To achieve these purposes, a cleaning apparatus with two scraper elements is proposed for the cleaning of a spin rotor. With these two scraper elements, the inner wall, especially the rotor groove of the spin rotor bowl is to be scraped. For cleaning, either the cleaning head is to be rotated by an appropriate drive, or the spin rotor itself must turn while the cleaning head with its scraper elements is held motionless.

Advantageously, it is the cleaning head which should be rotated, since, with an opened spinning box, the already applied brake for holding the rotor motionless need not be again released in order to rotate the spin rotor. The sum of the force vectors, which forces arise on the rotor in a radial direction from the contact force of the scraper element, is zero, or nearly zero. Thus, no tilt moment is generated on the spin rotor and the rotor bearing is not loaded, or only slightly loaded, during the cleaning operation. The protection of the rotor bearing is especially critical if the bearing design is based on aero or magnetic principles. Very little tolerance for bearing displacement is allowed. As a rule, stationary loadings are more likely to bring forth damage than the dynamic loadings for which the bearing was designed.

In graphic terms, the pneumatically extendable scraper elements protrude in the manner of claws following the insertion of the cleaning head into a rotor bowl. Thus, the outside dimensions of the rotor head are to be kept appropriately small to allow its entry into the rotor bowl and to allow the cleaning head to penetrate even small openings in the rotor bowl. Once in place, the extended scraper elements spread themselves within the rotor bowl, which bowl structure captures the generated forces almost completely, without allowing the rotor shaft to be subjected to a tilting or coupling moment. In one embodiment, provision has been made, that a rotor head, in a direction radial to the spin rotor, is supported on floating bearings, so that upon the contact of the scraper against the rotor head, a self-centering effect takes place. Advantageously, the rotor head is mounted on a run-out unit, which in turn is placed on a service cart which has access to each spinning station.

The scraper elements can be located on the circumference of the cleaning head in various angular positions allowing the resultant forces to be completely or nearly completely removed. A separation of about 180° can be mentioned as advantageous, wherein the scraper elements lie across from one another on the rotor wall. In other embodiments, three scraper elements can be separated at not more than 120° from one another, so that their combined application of force on the rotor bowl is likewise self-compensating.

In accord with a first aspect of the invention, the force components of the contacting action of several cleaning elements against a spin rotor head result in mutual compensation. In accord with a second aspect, the pneumatics are integrated in a compact manner within the extendable cleaning head for the placement of at least one scraper element. Both aspects can be realized separately or advantageously in combination. The compact mode of the pneumatic supply equipment which is integrated in the cleaning head is presented in the following as an embodiment, but however, can be also employed in the case of a cleaning head having at least one scraper.

Advantageously, the at least two scraper elements are extended by a single, compressed air driven piston. For this action, principally one pneumatically operated element is required to bring about a very compact construction of the cleaning head, wherein all installed scraper elements can be activated.

Very advantageously, the piston, in a case of at least one scraper element, is displaced in a radial direction in reference to the spin rotor, while the at least one scraper element principally executes a radial extension motion. By means of the special reversal of this motion the constructed depth of the cleaning head is shortened, and this leads to an even greater degree of compactness. Particularly advantageous is that at least one scraper element can pivot in its setting on the cleaning head. Because of the pivoted support of the scraper element, a large pivoted sweep of the element becomes possible thereby allowing applications to diverse types of rotors with considerably different rotor diameters. In addition, the penetration into the rotor groove is facilitated, if the rotor bowl bottom is designed to be particularly flat, or if the fiber slip walls have especially great circumferential lengths or are installed at an angle.

In a particularly advantageous manner, the retraction of the at least two extended scraper elements is carried out after the reduction of the air pressure for the pneumatic placement by means of the contractive force of a single O-ring, so that a separate retraction need not be carried out for each scraper element. If the securement and the retraction of at least one exchangeable seated scraper element is carried out by one O-ring, then an exchange of obsolete scraper elements can be accomplished by a simple removal of the O-ring, the insertion of a new scraper element and the replacement of the said O-ring. In this way, it is not necessary to have recourse to tools or parts of the cleaning head—with the exception of the O-ring—for disassembly and reassembly. Thus the result is, first, a very rapid maintenance operation and second, upon changing the spin rotor type, then special scraper elements can be installed to fit a new spin rotor type.

Advantageously, by means of compressed air nozzles, the contamination particles loosened by the scraper elements are blown out of the rotor bowl.

A scraper element, in accord with the invention, particularly designed for the cleaning of a spin rotor on an open end spinning machine, possesses an aperture with a pivot axis and a scraping surface. The scraper element consists of two legs, bound together, wherein at one end of a first leg, the aperture with the pivot axis is found, while on one end of the second leg the scraping surface is formed. Provided on one end on at least one of these legs remote from the scraping surface and pivot axis is a first control surface for rotating the scraper element about the pivot axis. In this way, a scraper element has been created which, in its installed condition and considering the generated and exercised forces present, is very simple to control. By means of the first control surface, the scraper element is swung about the pivot axis and pivoted into the rotor. The scraper surface displaces itself when this occurs in a direction toward the rotor groove, and is then positioned so that, upon a relative motion between the scraper element and the rotor, the rotor groove is cleaned. The torque which can be applied and forces are advantageously diverted onto the scraper element by the arrangement of the rotational axis, the first control surface and the scraper surface. In this way, a proportional, but still powerful pressure can be exercised by the scraper surface on the rotor groove, whereby the cleaning action can be controlled in a highly specific manner.

It is of particular advantage, if the legs form an angle of less than 120°. In this way, even by small spin rotors a particularly simple pivoting of the scraper surface into an effective position is possible.

If the two legs are bound on their ends to one another, and at the same time the control surface finds itself essentially at the end of that same leg, which has the scraper surface, then a particularly direct input of power is available for the scraper surface and correspondingly, this force is exercised on the location to be cleaned of the spin rotor.

If the scraper surface is arranged on the leg angularly, then a particularly simple and effective cleaning is possible in the case of especially deep rotors, or where rotors with large backcuts or complicated rotor groovings are employed.

It is particularly advantageous if the scraper is designed to be clawlike with an essentially concave inner side and an essentially convex outer side.

With this arrangement, the rotor rim is aggressively attacked by the pivoting of the scraper element and the rotor groove is very simply acted upon by the tilt-motion of the scraper element moving about its pivot axis.

In the defining installation of the scraper element, the pivot axis of the scraper element is remote from the axle of the rotor, so that a central control of several scraper elements is possible with one piston. The control is carried out, in this case, in proximity to the rotor axle, on which several scraper elements are closely aligned. The pivot axis of the scraper element is located in a place in which sufficient space is allowed for the fastening of the scraper element.

If the pivot axis is placed in a groove-shaped recess of the scraper element, then a very easy replacement of the scraper element is made possible. This would be required in case of abrasive wear, or if a different kind of scraper element need be installed. In the case of this groove-shaped recess, the scraper element can be clipped onto a fixed axle of the cleaning apparatus and in this manner be fastened for the application of cleaning. Upon the exchange of the scraper element, it can then be released from the clip and removed from the cleaning apparatus. The groove-shaped recess is, in this respect, especially advantageous for a quick maintenance visit at the cleaning apparatus.

If the scraper has a detent surface between the pivot axis and the control surface, then a defined positioning of the scraper during its idle period is possible. This is advantageous in order to avoid a collision of the cleaning apparatus with the spin rotor upon inserting the cleaning apparatus therein.

Because of the capability of simplified manufacturing, it is an advantage if the first control surface of the scraper element and/or the detent surface are essentially designed as flat surfaces.

A further second control surface of the scraper element is placed, advantageously, on the concave inner side of the scraper, in order to be able to retrieve the scraper element from the workstation during an idle period. Although the first control surface of the scraper element is intended for the purpose of bringing the scraper element out of the idle position into the operational position, the second control surface has the converse purpose of bringing the scraper element out of the operational position back into the idle position.

It is particularly advantageous in this matter, if the second control surface for the retrieval of the scraper element is designed with a domelike curvature. In this way, it can act with an O-ring, which exercises a springlike force on the scraper element in the direction of the idle position.

In order to bring a directed and defined force onto the scraper surface and at the same time design the scraper element to be economical in its manufacture, it is preferable if the scraper element is furnished with reinforcing ribs.

Plastic material, in particular polyamides, is a good material for the scraper element. In order to procure a scraper element of the greatest possible operational life, it is an advantage if the scraper element is reinforced with fibers.

If the scraper element is constructed so that it can be exchangeably fastened into the cleaning apparatus as far as possible without tools, then a very economical maintenance of the cleaning apparatus has been achieved.

Further, the scraper element can be constructed to work within a group of different rotor diameters or within different kinds of rotors, so that, in the case of an exchange of the spinning means, an exchange of the scraper element is generally not required. Even in this case, the mounting and the maintenance costs are reduced.

The invention will be more closely described and explained with the aid of embodiments shown in the illustrating figures.

BRIEF DESCRIPTION OF THE DRAWINGS

FIG. 5 shows a perspective view of a scraper element; and

FIG. 6 shows a side view of a scraper element.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
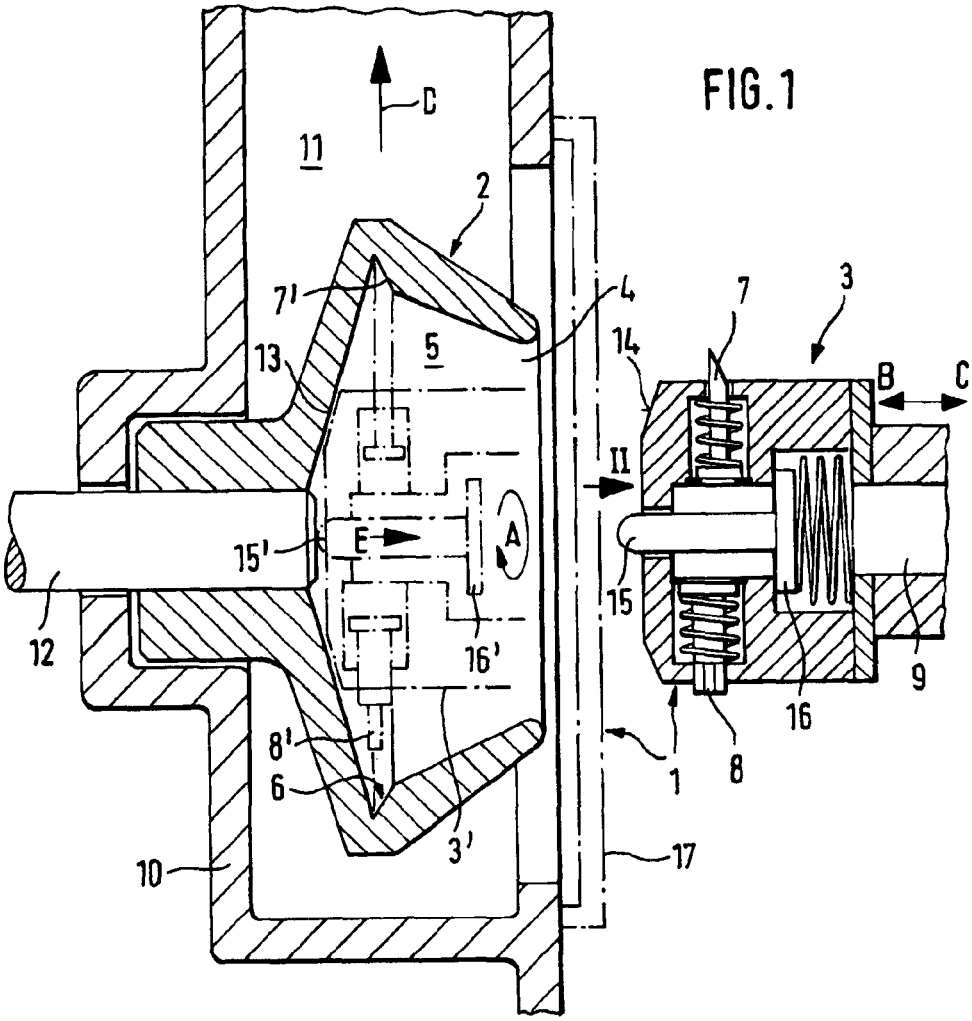
FIG. 1 shows an axial section is shown in an enlarge presentation through a spin rotor in stillstand as well as an insertable, cleaning head which is mounted on a startup cart.
Figure 2:
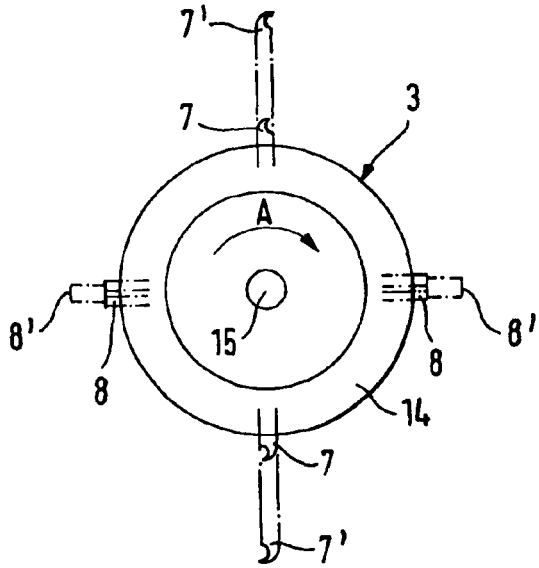
FIG. 2 shows plan view in the direction of the arrow 2 of FIG. 1, as seen externally onto the cleaning head.

The apparatus 1 depicted in FIGS. 1 and 2, serves for the cleaning of a motionless spin rotor 2, which, preferentially is held still by the action of a (not shown) braking means. Normally what is involved here is a spin rotor 2 having a small diameter, preferably less than 30 mm, as is conventionally used today.

The apparatus 1 contains a cleaning head 3, which, advantageously is a component of a (not shown) traveling service cart. This cleaning head 3 is, in case of maintenance attention, displaceable in the directions B and C and, upon requirement, can be inserted through the open forward side 4 into the interior 5 of the spin rotor 2, as is indicated by the dotted outline of the cleaning head shown in position 3'. The cleaning head 3 serves for cleaning the fiber collection groove 6 in the interior 5 of the spin rotor 2 at specified intervals during an interruption of the spinning procedure. During the spinning operation, the fiber collection groove 6, is the collection zone for fibers. The cleaning head 3 possesses several mechanical cleaning elements 7, advantageously designed as scrapers, as well as a plurality of compressed air nozzles 8. The mechanical cleaning elements 7, in accord with the position 7' designated in dotted lines, can be placed within the fiber collection groove 6, while the compressed air nozzles 8 are located either stationary on the cleaning head 3 (position 8) or made to approach the fiber collection groove 6 to a certain degree.

In the axle of the cleaning head 3 an axial boring performs as a compressed air connection 9, through which the necessary compressed air for the cleaning of the spin rotor 2 can be introduced in a yet to be described manner. Since the spin rotor 2, as has already been mentioned, stands still during the cleaning procedure, the cleaning head 3 can be connected to a (not shown) rotational drive mechanism A. In this way, the entire circumferential area of the fiber collection groove 6 can be reached by the cleaning elements 7 and air nozzles 8.

The spin rotor 2 is encased in rotor housing 10, which encompasses a suction chamber 11, which, upon the operation of the open end spinning aggregate, is tightly closed. The exhaust direction of the suction is designated by D, which, upon the operation of the open end spinning aggregate serves, in the first line of importance, the purpose of feeding by air transport the fiber material to be spun into the fiber collection groove 6. A shaft 12 is available to the spin rotor 2, which, in a sealed manner, penetrates the back wall of the rotor housing 10 and in a manner not shown, is supported and driven on bearings outside of the rotor housing 10.

Since the individual components of the spinning aggregate are continually involved with low tolerance clearances, provisions have been made that the cleaning head 3 upon introduction into the interior 5 of the spin rotor 2 is precisely aligned relative to the fiber collecting groove 6. To this end, in the interior 5 of the spin rotor 2, an axial detent 13 is located against which the cleaning head 3 abuts. The axial detent 13 also serves for the radial centering of the cleaning head 3. The axial detent 13 is contoured to be slightly conical in form whereby a complementary conical contact surface 14 of the cleaning head 3, in a self-centering manner, lies against the said axial detent 13. The cleaning head 3, in this way, is advantageously installed in a springlike way (which is not shown) and is in precise alignment to the axle of the spin rotor 2 as well as to the plane defined by the circumference of the fiber collection groove 6.

Centered within the axle of the cleaning head 3 is placed a movable valve stem 15, which, when the contact surface 14 of the cleaning head 3 lies against the axial detent surface 13 of the spin rotor 2, is pressed somewhat further in the direction of the arrow E into the cleaning head 3, as may be seen in the dotted line position 15' of FIG. 1. This movement provides a free opening around a valve head 16 for the compressed air inlet line 9. This opening is evident in the valve head position 16' in the interior 5 of the spin rotor 2. When the axial detent surface 13 becomes functional, at the same time the mechanical cleaning element 7 and the compressed air nozzles 8 become connected with the compressed air inlet opening of fitting 9. Thereby the compressed air nozzles 8 make available the compressed air necessary for the cleaning, while the mechanical cleaning elements 7 are forced into the fiber collection groove by means of this compressed air. The invention, however, does not exclude the possibility, that the compressed air nozzles 8 can also approach the fiber collection groove 6 by a certain separating distance.

For this purpose, as is especially clearly shown in FIG. 1, the mechanical cleaning elements 7 as well as the compressed air nozzles 8 are served by one, displaceable piston in a pneumatic cylinder.

There is to be found on the cleaning apparatus 1, shown only by an indicating outline, a covering 17, which, in the activated state of the cleaning head 3, lies against the front side of the rotor housing 10, so that the effective suction in the interior 5 of the spin rotor can remove the particles of the contamination which have been loosened by the cleaning process.

Finally, it should be mentioned that before the insertion of the cleaning head 3, it is advantageous to blow out possible rings of fibers which could be found in the interior of the spin rotor 2 upon cessation of its rotation. On this account, it is a practical matter to provide (in a manner not shown) an additional separate compressed air nozzle for the apparatus 1, which blows into the interior 5 upon the opening of the spinning aggregate, as the spin rotor 2 is subjected to braking so that any possible fiber ring would be dispersed. Such a nozzle, for instance, could be mounted on the arm which carries the cleaning head 3 and would be activated as soon as the cleaning head 3 approaches, but is still outside of the spin rotor 2.

Thus, an apparatus 1 for the cleaning of a stationary, open end, spin rotor 2 is provided, with at least one cleaning head 3 connected to a rotational drive A. The cleaning head 3 can be centrally inserted into the interior 5 of the spin rotor 2 and has at least one mechanical cleaning element 7 which can be placed against a fiber collection groove 6 of the spin rotor 2 as well as at least one compressed air nozzle 8 which can be directed against the fiber collection groove 6. Both the cleaning element 7 and air nozzle 8 can be connected to one compressed air entry 9 in a boring in the axle of the cleaning head 3. For the cleaning head 3, an axial detent surface 13 is provided in the spin rotor 2, by means of which, in its functional state, both the at least one compressed air nozzle 8 as well a the at least one mechanical cleaning element 7 are connected with compressed air entry 9 and at least the mechanical cleaning element 7, by means of compressed air is presented to the fiber collection groove 6.

In this embodiment, the axial detent surface 13 is to be found in the interior 5 of the spin rotor 2. Also, the at least one compressed air nozzle 8 can be brought to confront the fiber collection groove 6. Advantageously, the axial detent 13 serves to radially center the cleaning head 3.

The FIGS. 3A to 3F show, in succession:

3A—a perspective view of a retracted scraper 21 of a cleaning head 20;

3B—a front view of a retracted scraper 21 of a cleaning head 20;

3C—a cross-section A—A of a retracted scraper 21 of a cleaning head 20;

3D—a cross-section A—A of an extended scraper 21 of a cleaning head 20;

3E—a profile view of a second embodiment of a cleaning head 20; and

Figure 3A:
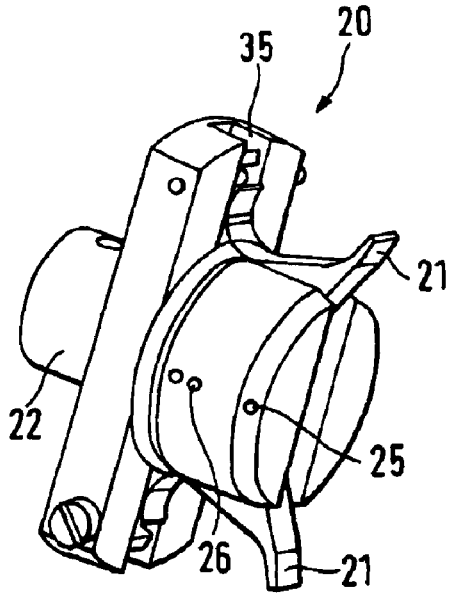
FIGS. 3A to 3F show a second embodiment of a cleaning head.
Figure 3B:
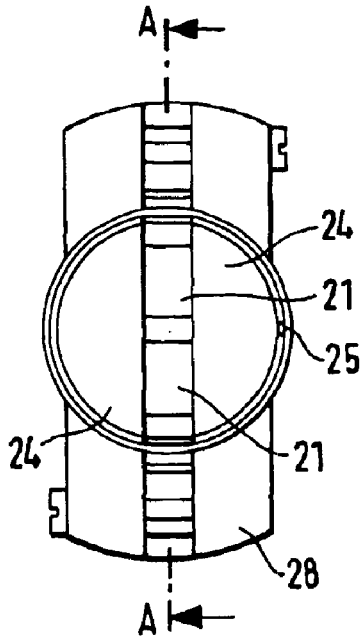
Figure 3C:
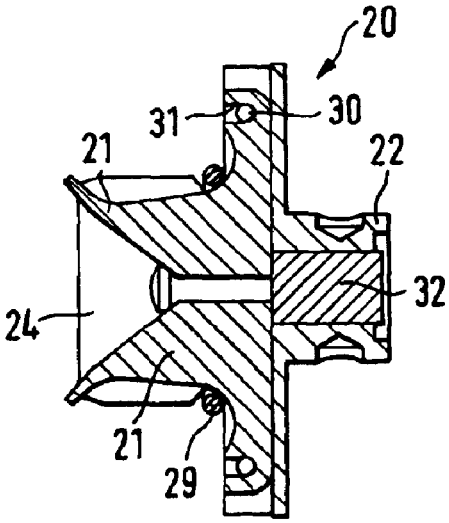
Figure 3D:
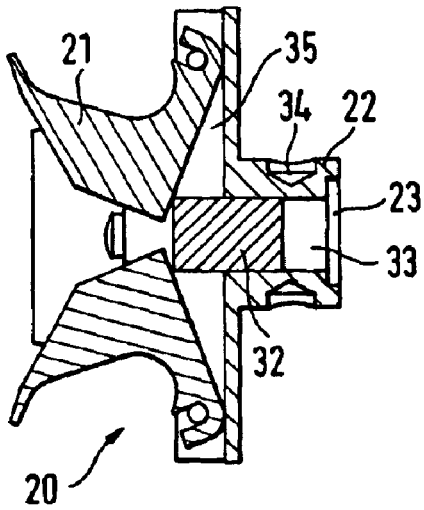
Figure 3E:
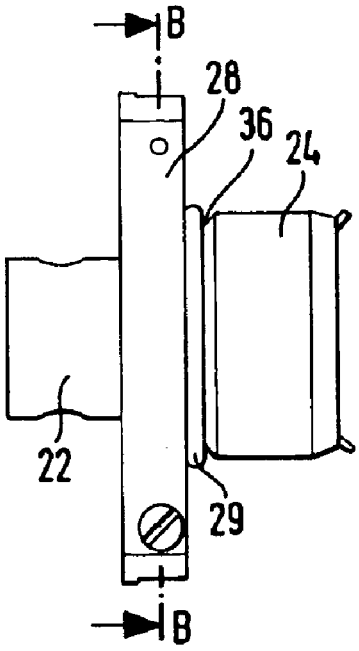
Figure 3F:
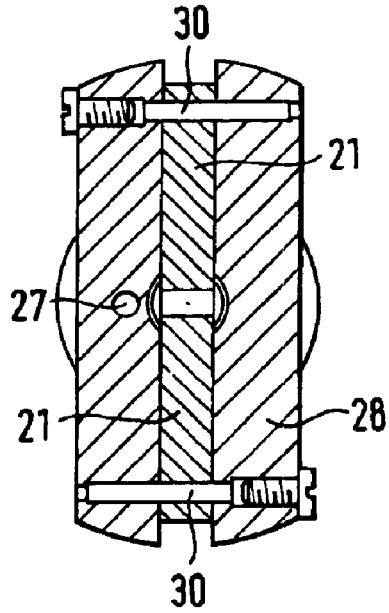

3F—a cross-section through line BB of cleaning head 20 in FIG. 3E.

The cleaning head 20 is exchangeably placed on an extendable apparatus and by means of a coupling piece 22 is connected to a drive motor. Such an extendable apparatus with a drive motor is discussed in DE 102 05 666.8, and is known in the art. Two pivotably supported pneumatically extendable scrapers 21 are in the cleaning head 20. FIG. 3A shows the scraper 21 in a partially extended condition. As is evident from the cross section of FIG. 3D, the coupling piece 22 has a central compressed air connection 23 and threaded, centering borings 34. After the setting of the coupling piece 22 in a recess with a compressed air connection (of an external extension means not further described), the coupling piece is secured and properly aligned by means of set screws, which are threadedly engaged in the centering borings 34.

During the pivoting motion and the cleaning operation, the scrapers 21 are supported and guided by the side members 24. In one of the side members 24 is provided a compressed air channel 27 (FIG. 3F), which delivers compressed air to one forward compressed air nozzle 25 on the forward side of the side member 24 and to two rear compressed air nozzles 26 on the side of the side member 24 (see FIG. 3A). In the case of one embodiment, it is possible that in both side members 24, a corresponding channel 27 and nozzles 25, 26 can be provided in a symmetrical arrangement.

The extension apparatus, which is not described here in further detail, has a position sensor, that is, a propinquity switch, which announces to a control center that the extension apparatus has extended to its predetermined limit and reached the desired position. By means of this positional announcement, the determination is made that the cleaning head has completed its insertion into the rotor bowl, so that, by means of a solenoid valve, the compressed air may be applied for the extension of the scraper 21. In another embodiment, provision can be made, that, instead of the position sensor or in addition to the position sensor, an activation means 15, 16, as shown in FIG. 1 can be provided. In an embodiment such as shown in FIG. 1, an axial alignment of the cleaning head is assured, while in the case of an embodiment with the sensor, a detent of the cleaning head on the rotor bowl base is not necessary and thus axial forces, for example, acting on an air bearing are avoided. In an embodiment, not pictorially presented here, the extension unit can possess a floating bearing arrangement for the cleaning head, which acts radial to the spin rotor, so that after the extension of the scraper, that is, during the cleaning operation, a radial self-centering takes place between the rotor and the cleaning head.

Following the insertion of the cleaning head 20 into a rotor head (not shown here), the forward compressed air nozzle 25 blows compressed air into the rotor groove of the rotor bowl, while the rear compressed air nozzles 26 direct an air stream on the fiber sliding wall of the rotor teller. The side support members 24 rest upon a base plate 28, onto which, in turn, the coupling piece 22 connects. In the base plate 28, is cut a longitudinal groove 35, in which rest the lower sides of the scraper 21, when in the retracted position. In the end zone of the groove 35, are installed two pivot axles 30 on which the scraper 21 is pivotably supported. As presented, the axles 30 are the cylindrical mid-portions of cylinder head screws screwed into the base plate 28. Instead of these, however, drift pins or splined pins could be inserted into the borings in the base plate 28. A U-shaped groove 31 of the scraper only partially encompasses the axle 30, so that the scraper 21 after being swung out about 90° from the axle 30 can be taken out and exchanged. In this way, a very simple and rapid exchange of worn scrapers 21 for other scrapers can be carried out.

The side members 24 are encompassed at their bases by an O-ring 29, which fits into an O-ring groove 36 around the two side members 24 (see FIG. 3E).

In the position depicted in FIG. 3C of the scrapers 21, these have been pressed back into the basic position shown by means of the continuous sections of the O-ring running between the two side parts 24. In a non-loaded situation, the O-ring 29 prevents also a 90° swinging out of the scraper, so that, by the action of the O-ring 29 and at the same time being restrained by the axles 30, the scraper 21 is securely seated in the cleaning head 20 and its falling out therefrom is prevented.

Through the coupling piece 22 and the base plate 28, penetrates a cylindrical boring 35, which extends itself partially from behind into the side pieces 24 (FIG. 3D). In the cylinder boring 33, a piston 32 slides, which piston, upon the application of compressed air at the compressed air connection 23, is displaced forward. By means of the forward displacement of the piston 32, the pivotable scraper 21 swings about its axle 30. FIG. 3C shows the basic position of the piston 32 and the scraper 21 at zero pressure. FIG. 3D shows the position of the piston 32 and the scraper 21 after the application of compressed air from the compressed air fitting 23. In this state, the piston 32 is partially displaced forward and the scrapers 21 are correspondingly partially pivoted forward about the axles 30. In the cylinder boring 33 is placed (not shown) a detent, which blocks the travel of the piston 32, so that first, the piston is not pushed out of the boring 33 and second, the side wall of the piston 32 does not continue movement between the two scrapers 21. In this way, assurance is given that, by the lever action of the a scrapers 21 which are prestressed by means of the O-ring 29, the undersides of the scraper 21 press the piston back into the originating position as soon as the air pressure is reduced. The clawlike extension of the scraper 21 that is caused by the projection of the piston 32 is carried out over a wide pivoting zone, so that a cleaning head 20 with the same scraper 21 can be installed for different rotor diameters.

Further, by means of varying the pressure of the air, which acts upon the piston, the corresponding lever action and hence the contact pressure of the scraper points on the rotor groove can be adjusted over a wide range.

Figure 4A:
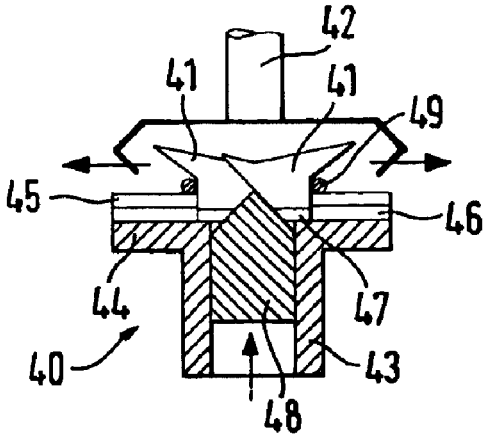
FIGS. 4A and 4B shows a third embodiment of a cleaning head.
Figure 4B:
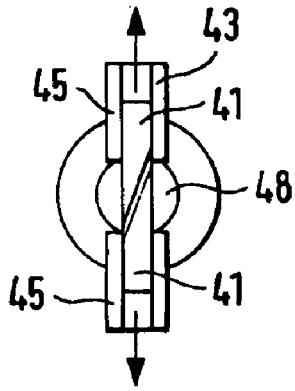

FIGS. 4A and 4B show a cross-sectional view and a front view of another embodiment of a cleaning head 40. Two scrapers 41 can, in this embodiment, be laterally separated within linear guides by a piston 48. In FIG. 4A, a spin rotor 42 is additionally schematically indicated with the cleaning head 40 already introduced into the spin rotor 42 before the scrapers 41 have been extended. The cleaning head 40, corresponding to the cleaning head 20, has a coupling piece 43 with a centrally bored compressed air connection. Penetrating the coupling piece 43, through a base plate 44, and partially between the side pieces 45, runs a cylindrical guide for a piston 48. The thrust of the piston 48 is limited by projections on the side pieces 45, so that the piston 48, upon application of pressure, is not propelled out of the guide cylinder. In the side pieces 45 is formed, respectively, a groove 46 into which guide projections 47 protruding from both sides of the scrapers 41 engage. The side pieces 45 serve for the guidance and securement of the scrapers 41. An O-ring 49 is stretched circumferentially about scrapers 41, so that, in a pressure-free condition, the O-ring 49 forces the scrapers 41 back into their basic position shown in FIG. 4A. In this way, unextended scrapers 41 can be inserted through the free opening of the rotor bowl. When the scrapers 41 extend and retract, the smoothed inclined sliding surfaces of the apex of the piston 48 and the complementary back sides of the scrapers 41 slide on one another, thus converting the forward or backward motion of the piston 48 into side directed movements of the scrapers 41. For an exchange of the scrapers 41, the O-ring is removed and the scrapers can be pulled out sideways from the groove 46. In this way, a quick exchange or replacement of the scrapers 41 becomes possible.

The designs of the axial detent surfaces, as presented in FIGS. 1 and 2, with the radial alignment by means of the detent surfaces and/or the compressed air admission from movement of the valve head 16 can be applied to the designs of the cleaning heads in accord with the FIGS. 3 and 4.

FIG. 5 shows a perspective presentation of an invented scraper element 21. The scraper element 21 has a first leg 37 and a second leg 38. The two legs 37, 38, are bound together on one end with each other, so that a hooklike or claw-shaped component is formed. On the free end of the leg 37 is to be found the groove 31, with which the scraper element 21 can be secured in the cleaning head 20 of FIG. 3. The free end of the second leg 38 has a scraping surface 39, which, during the cleaning of the spin rotor, is extended, pivoted and inserted into the spin rotor. Thereafter, due to relative motion between the spin rotor and the scraper element 21, a scraping motion is affected in the spin rotor. The scraper element 21 consists of an inner wall, which is peripherally bordered by a rib 51. With this construction, an especially high degree of stability is achieved for the scraper element 21.

On the ends of the legs 37 and 38 is located a first control surface 52. By means of the first control surface 52, the scraper element 21 can be pivoted about the axle 30 of FIG. 3. The axle 30 corresponds with an aperture with a pivot axis 55 of the scraper element 21.

Between the first control surface 52 and the aperture, or groove 31, is to be found a detent surface 53, placed on the first end 37. The detent surface 53 defines the resting position of the scraper element 21. The scraper element 21 strikes, in this arrangement, with its detent surface 53 against an abutment component of the cleaning head 20, whereby the scraper element 21 is secured in its idle position, in order to allow the cleaning head 20 to be inserted into the spin rotor bowl.

FIG. 6 shows a profile view of the scraper element 21 as derived from FIGS. 5, 3. The scraper element 21 consists of the two legs 37 and 38, which are connected at one end with each other. An the leg 38, the scraper surface 39 is angularly formed. By an arrangement of this kind of the scraper element 39, its engagement in the rotor groove is facilitated. The detent surface 53 is inserted between the groove 31 and the first control surface 52 of the leg 37. The first control surface 52 is placed on that end of the leg 37 remote from the groove 31. In the groove 31 runs the pivot axis 55 of the scraper element 21. Because of the groove 31, the changing of the scraper element 21 is very easily possible.

The scraper element 21 can simply be clipped onto the axle 30 (FIG. 3) and the scraper element 21 is subsequently rotatable about the axle 30, which corresponds to the pivot axis 55. In order to avoid a collision with an immovable component of the cleaning head 20, the end of the leg 37 is rounded-off concentrically to the pivot axis 55.

In order to be able to retract the scraper element 21 from its operational position into its idle position, an additional, or second, control surface 50 of the scraper element 21 is located on the concave, inner side of the scraper element 21. While the first control surface 52 of the scraper element is adapted to bringing the scraper element 21 out of its idle position into the operation position, the second control surface 50 is provided for the purpose of bringing the scraper element 21 out of the operating station and into its idle position. This functioning tail in FIG. 3.

Because of the dome shaping of the second control surface 50, the surface can, for example, work together with an elastic O-ring, which exercises a springlike force on the scraper element in the direction of returning the scraper element 21 to its idle position.

The present invention is not limited to the presented embodiments. Alterations within the bounds of the patent claims are allowable at any time. It will be appreciated by those skilled in the art various modification and variations can be made in the present invention without from departing from the scope of the invention. It is intended that the present invention include such modifications and variations as come within the scope of the appended claims and their equivalents.

What is claimed is:

1. A cleaning apparatus for cleaning a spin rotor of an open-end spinning station, said cleaning apparatus comprising:

a rotatable cleaning head insertable into an interior of an open side of said spin rotor;

at least two scraper elements carried on said cleaning head, said at least two scraper elements extendable outside of said cleaning head once said cleaning head has been inserted into said interior of said open side of spin rotor; and said at least two scraper elements controllably movable from a retracted position to a radially extended position after insertion of said cleaning head into said interior of said spin rotor to engage with a fiber collection groove within said spin rotor, said scraper elements disposed in such a manner that the sum of contacting forces created by said at least two scraper elements against said interior of said spin rotor is about zero.

2. A cleaning apparatus as in claim 1, wherein said at least two scraper elements are positioned at about 180° from one another.

3. A cleaning apparatus as in claim 1, wherein said cleaning head is rotatably connected to a drive unit for rotation of the cleaning head.

4. A cleaning apparatus as in claim 1, further comprising a compressed air inlet line operably connected to said cleaning head for supplying compressed air to said cleaning head.

5. A cleaning apparatus as in claim 4, further comprising at least one compressed air nozzle carried on said cleaning head, said at least one compressed air nozzle in communication with said compressed air inlet line.

6. A cleaning apparatus as in claim 1, wherein said at least two scraper elements have a convex outer surface and a concave inner surface, said convex outer surface and concave inner surface meeting to form a claw-like shape.

7. A cleaning apparatus as in claim 1, further comprising at least one spring element carried on said cleaning head and contactable with said at least two scraper elements, said at least one spring element retractably engaging said at least two scraper elements.

8. A cleaning apparatus as in claim 1, wherein said at least two scraper elements are replaceable.

9. A cleaning apparatus as in claim 1, wherein at least one spring element securably engages said scraper element on said cleaning head.

10. A cleaning apparatus for cleaning a spin rotor of an open-end spinning station, said cleaning apparatus comprising:

a cleaning head insertable into an interior of an open side of said spin rotor;

at least two scraper elements carried on said cleaning head, said at least two scraper elements extendable outside of said cleaning head once said cleaning head has been inserted into said interior of said open side of spin rotor;

said at least two scraper elements movable from a retracted position to a radially extended position after insertion of said cleaning head into said interior of said spin rotor to engage with a fiber collection groove within said spin rotor, said scraper elements disposed in such a manner that the sum of contacting forces created by said at least two scraper elements against said interior of said spin rotor is about zero; and wherein said at least two scraper elements are pneumatically extendable.

11. A cleaning apparatus for cleaning a spin rotor of an open-end spinning station, said cleaning apparatus comprising:

a cleaning head insertable into an interior of an open side of said spin rotor;

three scraper elements positioned at about 120° from each other carried on said cleaning head, said scraper elements extendable outside of said cleaning head once said cleaning head has been inserted into said interior of said open side of spin rotor; and said scraper elements movable from a retracted position to a radially extended position after insertion of said cleaning head into said interior of said spin rotor to engage with a fiber collection groove within said spin rotor, said scraper elements disposed in such a manner that the sum of contacting forces created by said three scraper elements against said interior of said spin rotor is about zero.

12. A cleaning apparatus for cleaning a spin rotor of an open-end spinning station, said cleaning apparatus comprising:

a cleaning head insertable into an interior of an open side of said spin rotor;

at least two scraper elements carried on said cleaning head, said at least two scraper elements extendable outside of said cleaning head once said cleaning head has been inserted into said interior of said open side of spin rotor;

said at least two scraper elements movable from a retracted position to a radially extended position after insertion of said cleaning head into said interior of said spin rotor to engage with a fiber collection groove within said spin rotor, said scraper elements disposed in such a manner that the sum of contacting forces created by said at least two scraper elements against said interior of said spin rotor is about zero;

a compressed air inlet line operably connected to said cleaning head for supplying compressed air to said cleaning head; and a compressed air loaded piston engagable with said at least two scraper elements for extending said at least two scraper elements, said piston loaded by said compressed air supplied by said compressed air inlet line.

13. A cleaning apparatus as in claim 12, wherein said piston is displaceable in an axial direction of said spin rotor.

14. A cleaning apparatus as in claim 12, wherein said piston possesses one or more inclined slip-walls which contact said at least two scraper elements to permit said at least two scraper elements to extend.

15. A cleaning apparatus as in claim 12, wherein said at least two scraper elements are pivotably supported by pivot axles within said cleaning head, said piston engaging said at least two scraper elements so that said at least two scraper elements are swingable about said pivot axles.

16. A cleaning apparatus for cleaning a spin rotor of an open-end spinning station, said cleaning apparatus comprising:

a cleaning head insertable into an interior of an open side of said spin rotor;

at least two scraper elements carried on said cleaning head, said at least two scraper elements extendable outside of said cleaning head once said cleaning head has been inserted into said interior of said open side of spin rotor;

said at least two scraper elements movable from a retracted position to a radially extended position after insertion of said cleaning head into said interior of said spin rotor to engage with a fiber collection groove within said spin rotor, said scraper elements disposed in such a manner that the sum of contacting forces created by said at least two scraper elements against said interior of said spin rotor is about zero;

at least one spring element carried on said cleaning head and contactable with said at least two scraper elements, said at least one spring element retractably engaging said at least two scraper elements; and wherein said at least one spring element is an O-ring.

17. A scraper element for use in a cleaning head which cleans a spin rotor of an open-end spinning machine, said scraper element comprising:

a first leg defining an aperture on one end of said first leg, said aperture defined by said first leg having a pivot axis;

a second leg integral to said first leg, said second leg forming a scraper surface on an end distal from said first leg; and said first leg possessing a first control surface that is engagable within said cleaning head to permit movement of said scraper element about said pivot axis.

18. A scraper element as in claim 17, wherein said first leg and said second leg form an angle of less than 120°.

19. A scraper element as in claim 17, wherein said end of said second leg having said scraper surface is bent at an angle.

20. A scraper element as in claim 17, wherein an end of said second leg distal from said end having said scraper surface is integral to an end of said first leg distal from said end of said first leg defining said aperture.

21. A scraper element as in claim 17, wherein scraper element has a convex outer surface and a concave inner surface, said convex outer surface and concave inner surface meeting to form a claw-like shape.

22. A scraper element as in claim 21, wherein said inner surface of said scraper element possesses a second control surface engaging said cleaning head to facilitate retraction of said scraper element back into said cleaning head after an extension of said scraper element out of said cleaning head occurs.

23. A scraper element as in claim 22, wherein said second control surface is dome shaped.

24. A scraper element as in claim 17, wherein said pivot axis of said aperture defined by said first leg is remote from a rotational axis of said spin rotor.

25. A scraper element as in claim 17, wherein said first control surface of said first leg is proximal to a rotational axis of said spin rotor.

26. A scraper element as in claim 17, wherein said first leg possesses a detent surface located between said control surface and said pivot axis of said aperture defined in said first leg.

27. A scraper element as in claim 17, wherein said aperture defined by said first leg is a groove defined by said first leg.

28. A scraper element as in claim 17, wherein said first control surface is essentially flat.

29. A scraper element as in claim 17, wherein at least one reinforcement rib is integrally positioned between said first leg and said second leg.

30. A scraper element as in claim 17, wherein said scraper element is made of a plastic.

31. A scraper element as in claim 30, wherein said plastic is a polyamide.

32. A scraper element as in claim 30, wherein said scraper element is reinforced with fibers.

33. A scraper element as in claim 17, wherein said scraper element is usable within said spin rotors of different diameters.

* * * * *

UNITED STATES PATENT AND TRADEMARK OFFICE

CERTIFICATE OF CORRECTION

PATENT NO. : 6,910,326 B2
DATED : June 28, 2005
INVENTOR(S) : Adalbert Stephan et al.

It is certified that error appears in the above-identified patent and that said Letters Patent is hereby corrected as shown below:

Title page,
Item [73], Assignee, please correct to read -- Rieter Ingolstadt Spinnereimaschinenbau AG --.

Signed and Sealed this

Eighteenth Day of October, 2005

JON W. DUDAS
*Director of the United States Patent and Trademark Office*